US008994297B2

(12) United States Patent
Teryaev

(10) Patent No.: US 8,994,297 B2
(45) Date of Patent: Mar. 31, 2015

(54) LOW-VOLTAGE, MULTI-BEAM KLYSTRON

(75) Inventor: Vladimir Teryaev, Protvino (RU)

(73) Assignee: Omega P Inc., New Haven, CT (US)

( * ) Notice: Subject to any disclaimer, the term of this patent is extended or adjusted under 35 U.S.C. 154(b) by 56 days.

(21) Appl. No.: 13/601,638

(22) Filed: Aug. 31, 2012

(65) Prior Publication Data

US 2013/0229109 A1 Sep. 5, 2013

Related U.S. Application Data

(63) Continuation-in-part of application No. 12/908,739, filed on Oct. 20, 2010.

(60) Provisional application No. 61/253,737, filed on Oct. 21, 2009, provisional application No. 61/394,623, filed on Oct. 19, 2010, provisional application No. 61/529,712, filed on Aug. 31, 2011.

(51) Int. Cl.
*H01J 23/00* (2006.01)
*H01J 25/10* (2006.01)

(52) U.S. Cl.
CPC ..... *H01J 25/10* (2013.01)
USPC ..... 315/500; 315/501; 315/502; 315/503

(58) Field of Classification Search
USPC ..... 315/500–607
See application file for complete search history.

(56) References Cited

U.S. PATENT DOCUMENTS

| | | | | |
|---|---|---|---|---|
| 3,886,398 | A * | 5/1975 | Feinstein | 315/5 |
| 3,886,399 | A * | 5/1975 | Symons | 315/5 |
| 3,916,246 | A * | 10/1975 | Preist | 315/5 |
| 4,401,918 | A * | 8/1983 | Maschke | 315/5.34 |
| 4,455,504 | A * | 6/1984 | Iversen | 313/30 |
| 4,508,992 | A * | 4/1985 | Bohlen et al. | 315/5.39 |
| 5,838,107 | A * | 11/1998 | Beunas et al. | 315/5.16 |
| 5,932,972 | A * | 8/1999 | Symons | 315/5.16 |
| 6,768,265 | B1 * | 7/2004 | Ives et al. | 315/5.16 |
| 7,385,354 | B2 * | 6/2008 | Miyake | 315/5.39 |
| 7,446,478 | B2 * | 11/2008 | Syratchev | 315/5.39 |
| 7,471,053 | B2 * | 12/2008 | Miyake | 315/501 |
| 8,547,006 | B1 * | 10/2013 | Ives et al. | 313/414 |
| 2011/0089829 | A1 * | 4/2011 | Teryaev et al. | 315/5.39 |

* cited by examiner

*Primary Examiner* — Douglas W Owens
*Assistant Examiner* — Srinivas Sathiraju
(74) *Attorney, Agent, or Firm* — Arent Fox LLP

(57) ABSTRACT

A low-voltage, multi-beam radio frequency source that operates at a voltage less than or equal to approximately 20-40 kV and that generates at least 600 kW at a pulse width of approximately 5-30 ms. The RF source includes an electron gun having a cathode configured to generate a plurality of beamlets. An input cavity and output cavity are common to the plurality of beamlets. A plurality of gain cavities are provided between the input and output cavities, each having a plurality of openings corresponding to the plurality of beamlets. The cathode may include 10-20 beamlet cathodes formed in a ring, each being configured to generate a single beamlet and each having beamlet optics independent of each other. A beam collector having a plurality of openings corresponding to each of the beamlets may be provided within the output section, where the openings have no RF coupling to each other.

20 Claims, 13 Drawing Sheets

The beam trajectories and equipotential lines in the gun are illustrated in the FIG. 3a. The shape of magnetic field on the axis of a beam is shown in FIG. 3b

Cathode loading as a function of radius.

3D View of a cut-away portion of the magnetic system.

Map of magnetic field in the output section.

Example of simulation of beam dynamics using 2D code MAGIC

Electric field strength in the transverse X-Y plane at the gap center in the input cavity.

Electric Field strength in the *y-z* plane.

The field along the axis (red) and along the edge (blue) of a beamlet. Electric fields of the cavity near a beamlet are axial-symmetrical.

Collector with independent openings for each of the beamlets.
Collector openings have no RF coupling to each other.

Trajectory

Phase space a) Modulated beam

Trajectory

Phase space 50 55 60 Z (cm) 65 b) Non-modulated beam

Electron gun with liquid insulator. Sizes not shown to scale.

LOW-VOLTAGE, MULTI-BEAM KLYSTRON

CLAIM OF PRIORITY

The present application for patent is a continuation-in-part of patent application Ser. No. 12/908,739 filed on Oct. 20, 2010, titled "LOW-VOLTAGE, MULTI-BEAM KLYSTRON," which claims priority to Provisional Application No. 61/253,737 entitled "LOW-VOLTAGE, MULTI-BEAM KLYSTRON" filed Oct. 21, 2009, and Provisional Application No. 61/394,623 entitled "LOW-VOLTAGE, MULTI-BEAM POWER SOURCE" filed Oct. 19, 2010, and claims priority to Provisional Application No. 61/529,712 entitled "RF CAVITY CHAIN AND MAGNETIC CIRCUIT" filed on Aug. 31, 2011, the entire contents of each of which are hereby expressly incorporated by reference herein.

BACKGROUND

1. Field

Aspects described herein relate generally to a low-voltage, multi-beam Radio Frequency (RF) source for accelerators and other industrial applications.

2. Background

Aspects described herein relate generally to a low-voltage, multi-beam RF source/amplifier for accelerators, e.g. a low-voltage Multi-Beam Klystron (MBK).

RF sources can be used to power accelerators, such as ILC-type SRF accelerator structures, such as in the high-energy portion of the proton linac for Project-X that is under development at Fermi National Accelerator Laboratory (FNAL), which is described in more detail in G. Appolinary, "Project X Linac, at http://projectx-docdb.fnal.gov/cgi-bin/RetrieveFile?docid=73&version=1&filename=LinacAAC_Apollinari.ppt, the entire contents of which are incorporated herein by reference.

In ILC as well as in Project-X, the main linacs would be constructed from one-meter long, nine-cell superconducting cavities operating at 1.3 GHz. Groups of 8-to-9 such cavities would be installed in a common cryostat, e.g. as described in S. Nagaitsev, "High Energy Linac Overview," Nov. 12, 2007, at http://projectx-docdb.fnal.gov/cgi-bin/RetrieveFile?docid=21 &version=1& filename=Nagaitsev.ppt#256,1, High_Energy_Linac_Overview, the entire contents of which are incorporated herein by reference.

Additional details regarding ILC main linear accelerators (linacs), can be found in "ILC Reference Design Report, August 2007, ILC Global Design Effort and World Wide Study," at http://tlcdoc.linearcollider.org/record/6321/files/ILC_RDR_Volumne_3-Accelerator.pdf?version=4, the entire contents of which are incorporated herein by reference.

Additional details regarding high-voltage MBKs are described in A. Beunas, G. Fullon and S. Choroba, "A High Power Long Pulse High Efficiency Multi-Beam Klystron," at http://tdserver1.fnal.gov/8gevlinacPapers/Klystrons/Thales-multi-_beam_Klystron_MDK2001.pdf, A. Balkcum, H. P. Bohlen, M. Cattelino, L. Cox, M. Cusick, S. Forrest, F. Friedlander, A. Staprans, E. L. Wright, L. Zitelli, K. Eppley, "Design and Operation of a High Power L-Band Multiple Beam Klystron, "*Proceedings of a* 2005 *Particle Accelerator Conference*, Knoxville, 2005, p. 2170, and Y. H. Chin, S. Choroba, M. Y. Miyake, Y. Yano, "Development of Toshiba L-Band Multi-Beam Klystron for European XFEL Project," *Proceedings of* 2005 *Particle Accelerator Conference*, Knoxville, 2005, p. 3153, the entire contents of each of which are incorporated herein by reference.

High voltage power sources are expensive and complex. Extensive cooling and shielding must be provided for such power sources. Thus, there is a need in the art for an RF amplifier that meets the necessary output parameters while operating with a lower beam voltage.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

In view of the above described problems and unmet needs, a number of benefits result from aspects of a low-voltage, e.g., approximately 650 kW, 1.3 GHz multi-beam klystron (MBK) with a low operating voltage in the range of approximately 20 to 40 kV, and a large duty factor of up to 10%. This can be applied as a power source in linacs capable of accelerating protons and ions up to several GeV. A peak power output of up to 660 kW can be provided in a pulse length between 5 to 30 ms having a pulse repetition rate of between 2 to 10 Hz. These aspects enable the same average power to be accomplished with various combinations of pulse length and repetition rate. For example, when the pulse length is increased, the repetition rate is reduced. This maintains the duty factor below approximately 10%.

Thus, (1) no pulse transformer would be required, (2) no oil tank would be required for high-voltage components and for the tube socket, (3) the modulator would be a compact 20 to 40 kV IGBT switching circuit built directly on the klystron, (4) high-voltage cables would not be required, and so forth.

Elimination of the pulse transformer could save perhaps 25% of the cost of the modulator, and would eliminate need to accommodate its 1-$m^3$ bulk and attendant weight that would make replacement a highly daunting task. Elimination of the large tank containing insulating oil for protection of the transformer and other high-voltage components would also reduce the bulk volume and weight of the installation, and reduce the complexity and fire hazard attending oil storage in a long confined tunnel. Finally, elimination of high-voltage cables connecting the modulator to the pulse transformer in the oil tank reduces the complexity and cost of the installation, and avoids complications that would attend their replacement. It is conceivable that elimination of these components could add further justification to a design for ILC and Project X that required only a single tunnel, rather than two; the savings in cost and complexity that this implies would be highly significant.

Aspects of such a low-voltage RF source may include an RF cavity chain, magnetic circuit, electron gun and beam collector for a low-voltage amplifier that operates with a beam voltage of only in the range of approximately 20-40 kV providing power output of up to 660 kW in a pulse length between 5 to 30 and a pulse repetition rate of up to 10 Hz, e.g., between 2 to 10 Hz.

The RF source may include an electron gun having a cathode configured to generate a plurality of beamlets. An input cavity and output cavity are common to the plurality of beamlets. A plurality of gain cavities are provided between the input and output cavities, each having a plurality of openings corresponding to the plurality of beamlets. The cathode may include between ten to twenty beamlet cathodes formed in a ring, each being configured to generate a single beamlet and each having beamlet optics independent of each other. Each beamlet cathode may be configured to form a beamlet having a diameter in the range of 6 mm, and wherein the RF source forms a beam tunnel between approximately 10 to 14 mm in which the beamlet propagates.

The RF source may comprise a beam collector having a plurality of openings corresponding to each of the beamlets may be provided within the output section, where the openings have no RF coupling to each other. The beam collector may further comprise a cooling feature that includes a passage formed in the collector at least partially surrounding the plurality of openings, and wherein the passageway is formed to receive a flow of cooling liquid.

The RF source may be driven by a power supply such as a switched power supply or a modulator, for generating the 20-40 kV pulse of desired width.

The electron gun may further include a ferrite damper. The input cavity, the output cavity, and the plurality of gain cavities may comprise a plurality of common coaxial cavities through which the beamlets pass.

The RF source may further comprise an air radiator configured to pass a flow of air through the RF source adjacent to the electron gun or a liquid dielectric system including a passageway configured to receive a flow of liquid, e.g., oil, adjacent the electron gun.

The RF source may further comprise a magnetic circuit configured to compensate for asymmetry experienced by the plurality of beamlets.

The magnetic circuit may include any of a pair of lenses, a gun solenoid having a uniform magnetic field in a region of the electron gun, and compensating coils provided in an output section of the RF source.

Additional advantages and novel features of these aspects will be set forth in part in the description that follows, and in part will become more apparent to those skilled in the art upon examination of the following or upon learning by practice of the invention.

To the accomplishment of the foregoing and related ends, the one or more aspects comprise the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

BRIEF DESCRIPTION OF THE DRAWINGS

The disclosed aspects will hereinafter be described in conjunction with the appended drawings, provided to illustrate and not to limit the disclosed aspects, wherein like designations denote like elements, and in which.

DETAILED DESCRIPTION

Figure 1:
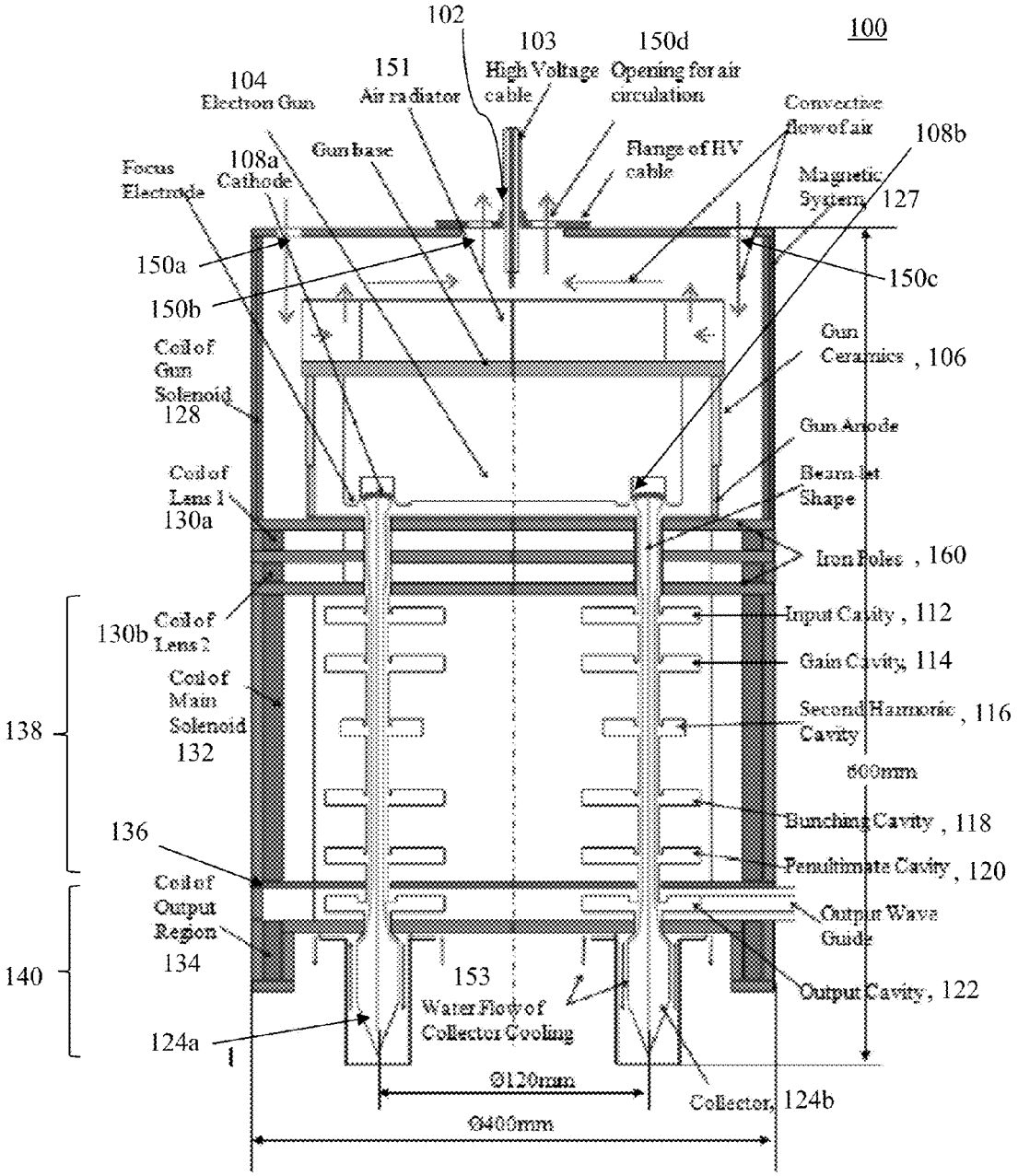
FIG. 1 illustrates example aspects of a low-voltage, multi-beam RF source.

Various aspects are now described with reference to the drawings. In the following description, for purposes of explanation, numerous specific details are set forth in order to provide a thorough understanding of one or more aspects. It may be evident, however, that such aspect(s) may be practiced without these specific details. These and other features and advantages are described in, or are apparent from, the following detailed description of various example illustrations.

In order to achieve the above described benefits, aspects presented herein include a low-voltage 650 kW, 1.3 GHz multi-beam klystron (MBK) with a low operating voltage in the approximate range between 20-40 kV, and a large duty factor of up to 10%. Aspects include the application of the MBK as a power source in linacs capable of accelerating protons and ions up to several GeV. A peak power output of up to 660 kW may be provided in a pulse length between 5 to 30 ms with a pulse repetition rate of up to 10 Hz, e.g., between 2 to 10 Hz.

The proposed MBK can be used as an RF source to power 1.3 GHz ILC-type SRF (super-conducting radio frequency) accelerator structures, e.g., of the pulsed 3-8 GeV linac of Project-X (PX), at acceleration gradients up to 25 MeV/m. PX, a multi-MW proton source, is under development at Fermilab. It will enable a world-leading program in neutrino physics and a broad suite of rare decay experiments. The facility is to be based on a 3-GeV, 1-mA-CW SRF linac. In a second stage, about 5-9% of the 3-GeV $H^-$ beam is to be accelerated up to 8 GeV in a SRF pulsed linac for injection into the Recycler/Main Injector synchrotron complex. The normalized beam velocity $\beta$=0.97 at the pulsed linac input allows for efficient acceleration in 1.3-GHz, ILC-type $\beta$=1 SRF cavities. Standard ILC-type cryo-modules containing 8 cavities and one focusing element will be used. A conservative accelerating gradient of 25 MeV/m is chosen so as to provide reliable operation in the pulsed regime. To mitigate against cavity distortions due to Lorentz forces and microphonics, the cavity may be over-coupled. The loaded Q is chosen to be $1.0\times10^7$, corresponding to a bandwidth of 130 Hz. Filling time in this case is 3 ms, and the entire RF pulse length is to be 7.3 ms. The input pulsed power is to be 32 kW per cavity (20% higher than for optimal coupling). If one klystron is to excite two cryomodules, it should provide a pulsed power of about 620 kW and an average power of about 45 kW, taking into account a 20% overhead for control and losses the power distribution system. Additional details regarding Project-X can be found in S. Nagaitsev, "Project-X new multi-megawatt proton source at Fermilab," Proceedings of the Particle Accelerator Conference (PAC) 2011, FROBN3; N. Solyak, Y. Eidelman, S. Nagaitsev, J.-F.

Ostiguy, A. Vostrikov, V. Yakovlev, "Conceptual design of the Project-X 1.3 GHz 3-8 GeV pulsed linac," PAC 2011, TUP015; and B. Aune et al., Phys. Rev. ST Accel. Beams 3, 092001 (2000), the entire contents of each of which are hereby incorporated by reference herein.

The proposed MBK operates with a beam voltage in the range of only approximately 20-40 kV, a value that keeps the individual beamlet perveance below approximately $0.8\times10^{-6}$ A-$V^{-3/2}$. To achieve this, the RF source comprises a tube having ten to twenty beamlet cathodes arranged in a ring. Additionally, the tube may further include the following aspects:

- 10-20 beamlets as formed from 10-20 cathodes, incorporated into a collective 10 to 20-beamlet gun;
- the gun including a ferrite damper to prevent gun self-excitation;
- a single beam collector having 10-20 channels (one for each beamlet), where each has a relatively low collector loading and no RF coupling to one another;
- common coaxial cavities;
- a $2^{nd}$ harmonic bunching cavity to raise efficiency and shorten the interaction region;
- a two-coil matching lens system allows a variable beam diameter and Brillouin parameter;
- a separate gun solenoid with a uniform magnetic field in the gun region; and
- compensation coils in the output section with a uniform magnetic field.

Additionally, low cathode current density loading implies long cathode lifetime. Low surface E-fields and identical field profiles in the beam-cavity interaction regions exist for each beamlet from the electron gun. The nearest higher-order mode is shifted far from the operating frequency using shunts, thereby avoiding problems from high order modes. Thus, straightforward tuning for the cavities can be provided.

In order to achieve the above described benefits, aspects presented herein include a low-voltage, multi-beam, multi-MW RF source, having a low-voltage cathode configured to generate a plurality of beamlets; an input cavity common to the plurality of beamlets; an output cavity common to the plurality of beamlets; and a plurality of gain cavities provided between the input cavity and the output cavity, each having a plurality of openings corresponding to the plurality of beamlets, wherein the power source operates at a voltage less than or equal to approximately 20-40 kV and generates the order of least 600 kW. Aspects may further include a magnetic circuit configured in common to the beamlets that compensates for asymmetry experienced by various beamlets.

The proposed MBK operates at a beam voltage≤approximately 40 kV, a value that is determined by the desire to keep the individual beamlet perveance below about $0.8\times10^{-6}$ $AV^{-3/2}$.

Common input and output cavities may be used. Intermediate gain cavities may be used, including a second harmonic bunching cavity that increases efficiency and shortens the interaction region. A 2-coil matching lens system allows variable beam diameter and Brillouin parameter. A gun solenoid, with a uniform magnetic field in the gun region may be used. Compensation coils in the output section, with uniform magnetic field may be used.

Other advantages of the aspects of the MBKs described herein include simple gun design that mitigates against hot dimension problems and avoids self-excitation. Low cathode current density implies long cathode lifetime. Low surface electric fields and identical electric field profiles in the beam-cavity interaction region are seen by each beamlet. Nearby higher-order mode competition issues are avoided by shifting the mode frequencies using shunts. Simplicity in the design enables easy cavity tuning.

The low-voltage multi-beam klystron described herein holds the potential to reduce both cost and complexity for the FNAL Project X proton accelerator, and other accelerator projects. Cost savings can result for a lower voltage tube because of no need for high-voltage pulse transformers, large oil-filled high-voltage tanks, and high-voltage cables. Reduced hazard would also result by elimination of the large volumes of insulating oil needed for a higher-voltage installation. Moreover, the tube itself is expected to be less costly than existing high-voltage L-band MBK's, because of its need for a smaller insulator and its inherent smaller size. Simplifications that can result include a compact IGBT switched modulator, smaller total footprint and height for the entire high-power RF system, and the possibility of a design for ILC requiring only one tunnel. The one-meter high tube described here could conceivably be mounted vertically in the tunnel, with the compact modulator mounted directly on the gun socket.

Figure 2:
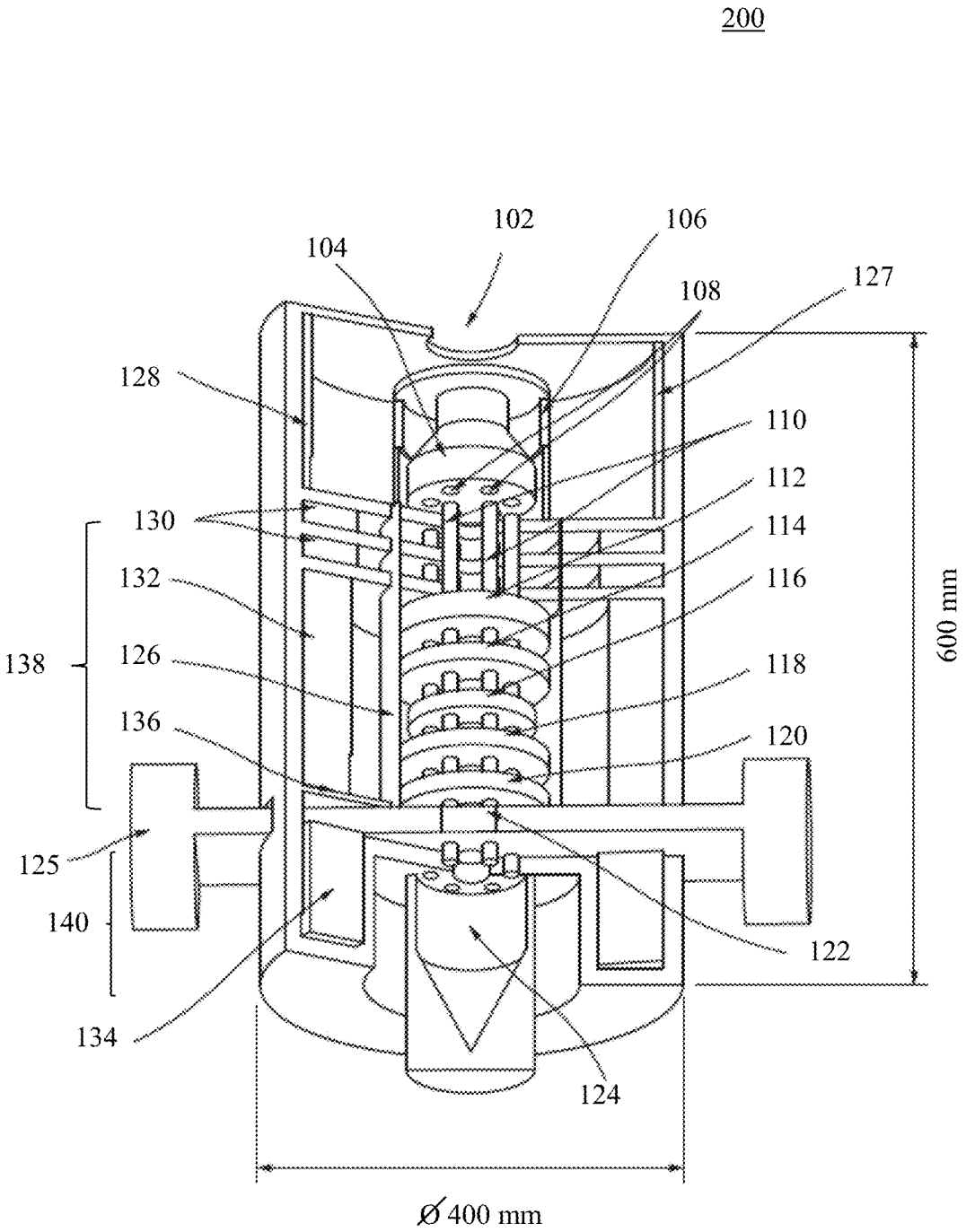
FIG. 2 illustrates example aspects of a low-voltage, multi-beam RF source.

FIG. 1 illustrates aspects of an example cross section of an RF source. In FIG. 1, the MBK 100 includes an opening 102 for a high voltage input, e.g., a high voltage cable 103. An electron gun 104 includes cathode ceramics 106 configured to generate a plurality of beamlets at each of beamlet cathodes 108*a*, 108*b*. Although the cross section only enables a view of two beamlet cathodes 108*a*, 108*b*, cathode 106 may be configured to include between 10-20 beamlet cathodes 108. Beamlet drift tubes 110, e.g., as illustrated in FIG. 2, may be used to connect between the beamlet cathodes and input cavity 112. The input cavity is provided in common to the beamlets of the electron gun 104. A series of gain cavities, e.g. a gain cavity 114, a second harmonic cavity 116, a bunching cavity 118, and a penultimate cavity 120 are provided in line after the input cavity 112. Each of the coaxial cavities includes a plurality of openings, one opening for passing each of the beamlets. An output cavity 122 is provided common to each of the beamlets at the end of the group of gain cavities 114-120 opposite the input cavities 112. Beam collector channels 124*a*, 124*b* are provided in a collector adjacent the output cavity 122 at the end of the klystron opposite the electron gun 104. The output cavity may further include an output RF window 125, e.g., as illustrated in FIG. 2. Although the cross section only enables a view of two beam collector channels 124*a*, 124*b*, a beam collector is provided for each of the 10 to 20 beamlets. A technological hole may lead to the beam collector. The technological hole provides access for cooling, connections, and other maintenance access but does not affect the operation of the MBK.

The drive and the output cavity may be configured so as to insure acceptable surface electric fields, good output efficiency, as well as absence of parasitic self-excitation in all possible regimes of tube operation. The output cavity may be coupled into two WR-650 output waveguides, e.g., WR-650 output waveguides. A coupling arrangement may be provided from the output cavity into two integral output waveguides and windows.

The geometries of the RF cavities and the magnetic field profile may be configured in order to eliminate self-excitation of parasitic modes.

The electron gun 104 and sets of cavities 112-122 are surrounded by a klystron body, and a magnetic system 127. The magnetic system includes a gun solenoid 128, a pair of lens coils 130*a*, 130*b*, a solenoid coil 132, and a coil 134 surrounding the output section. An iron plate 136 divides the cavity section 138 from the output section 140. The magnetic system should be configured to achieve an optimal field profile that provides maximum tube efficiency. The magnetic system should also provide optimal beam matching with the electron gun and optimal beam dispersion of the beam in the beam collector. For example, the magnetic circuit may be configured to compensate for asymmetry experienced by the plurality of beamlets. The magnetic circuit may include a pair of lenses 130*a*, 130*b*, e.g., a two coil matching lens system that allows a variable beam diameter and Brillouin parameter. The magnetic circuit may include a gun solenoid 128 having a uniform magnetic field in a region of the electron gun. The magnetic circuit may include compensating coils 134 provided in an output section, with a uniform magnetic field.

The magnetic system may be divided by iron pole pieces into regions of independent control. These are regions of the gun, the matching optical system comprises a pair of lenses, the solenoid, and the output coil. The system of coils provides compensation of transverse fields on the axis of each beam-let to a level of ±0.5% of the longitudinal field. Non-compensated values are the angular components of magnetic field produced by beam currents. The cross-sectional area of the magnetic system should be configured to provide a large enough space to be occupied by a total beam current. The transverse fields produced by this current should not exceed the abovementioned level. The proposed magnetic system provides the necessary magnitude of a magnetic field in the solenoid, and insignificant values of tangential magnetic fields. Deviations of a beam-let from an axis should not exceed approximately 0.5 mm.

Other features may include a pair of matching lenses provide focusing of beamlets over a wide range of parameters. Independently adjustable magnetic field in the output section may allow one to optimize efficiency of klystron and to minimize current interception of beam on walls. Sources of tangential magnetic fields may be considered and minimized.

The overall height of the illustrated MBK is approximately 60 cm with an approximately 40 cm diameter. The RF source in FIG. 1 generates a peak power output of up to approximately 660 kW in a pulse length in the approximate range of 5 to 30 ms, and with a pulse repetition rate of up to 10 Hz, e.g., 2-10 Hz.

In order to generate the desired pulse width, the RF source may be driven by a switched power supply or modulator.

FIG. 1 also illustrates example cooling aspects that may be provided in the MBK. For example, openings 150*a-d* may be provided in the side of the MBK housing the electron gun 104. In FIG. 1, arrows illustrate the convective air flow through these openings. An air radiator 151 may be provided inside the MBK. The air radiator 151 may be configured to pass a flow of air through the RF source adjacent to the electron gun 104, as illustrated in FIG. 1.

Water cooling aspects may be included, e.g., at the output portion of the MBK. FIG. 1 illustrates with arrows a path 153 for flowing cooling water through a portion of the collector adjacent to the collector channels 124*a*, 124*b*, etc.

Example parameters for the low-voltage, L-band MBK in FIG. 1 are listed in Table 1.

TABLE 1

Example Parameters for the MBK in FIG. 1

| | | |
|---|---|---|
| cavity circuit | | coaxial cavities, one $2^{nd}$ harmonic cavity |
| number of cavities $N_{cav}$ | | 6 |
| number of beamlets $N_{beamlet}$ | | 18 |
| operating frequency $f_o$ | GHz | 1.3 |

TABLE 1-continued

Example Parameters for the MBK in FIG. 1

| | | |
|---|---|---|
| beam voltage $V_b$ | kV | 22 |
| beamlet current $I_{beamlet}$ | A | 2.56 |
| total beam current $I_b$ | A | 46 |
| beamlet perveance $K_m$ | A-V$^{-3/2}$ | $0.784 \times 10^{-6}$ |
| total perveance K | A-V$^{-3/2}$ | $14.1 \times 10^{-6}$ |
| beam power $P_{beam}$ | kW | 1000 |
| output RF power $P_{RF}$ | kW | 660 |
| input RF power $P_{input}$ | W | 7 |
| efficiency (conservative estimate) | % | 66 |
| efficiency (from simulation) | % | 70 |
| saturated gain | dB | 50 |
| pulse width $t_{pulse}$ | ms | 7.5 |
| repetition rate $f_{pulse}$ | Hz | 13 |
| average output RF power $P_{RF\text{-}average}$ | kW | 50 |
| distance between beamlets $L_{bb}$ | mm | 20 |
| diameter of ring of beamlets $D_{bb}$ | mm | 120 |
| diameter of beamlet cathode $D_{cath}$ | mm | 12 |
| focus electrode diameter $D_{foc}$ | mm | 140 |
| cathode loading (average) $J_{cath}$ | A/cm$^2$ | 2.26 |
| cathode loading (peak) $J_{cath\text{-}peak}$ | A/cm$^2$ | 2.5 |
| heater power of cathodes $P_{cath}$ | W | 200 |
| cathode temperature $T_{cath}$ | ° C. | 950 |
| cathode lifetime | hour | $>10^5$ |
| diameter of beamlet tube $D_{tube}$ | mm | 9.6 |
| average diameter of beamlet $D_{beam}$ | mm | 6 |
| diameter of input beamlet tube $D_{input}$ | mm | 14 |
| diameter of output beamlet tube $D_{output}$ | mm | 12 |
| cavity gap, $H_{cav\ gap}$ | mm | 10 |
| gap of output cavity $H_{out\text{-}gap}$ | mm | 8 |
| half of plasma wavelength $\lambda_p/2$ | mm | 390 |
| beam focusing system | | adjusted system with a double lens |
| Brillouin magnetic field $B_{Br}$ | kG | 0.36 |
| operating magnetic field in solenoid $B_{sol}$ | kG | 1 |
| power needed for magnetic system | kW | 4 |
| collector type | | with a channel for each beamlet |
| collector average power | kW | 60 |
| collector surface loading | W/cm$^2$ | <100 |

FIG. 2 illustrates a partially cut-away view of an example MBK that illustrates a common cathode, input and gain cavities 112-120, an output cavity 122, and a beam collector 124. As noted above, between 10-20 beamlet cathodes 108 may be provided in cathode 106.

The electron cathodes 108 immersed in the guide magnetic field each inject a focused pencil beam into the chain of gain cavities 112-120 forming the RF system. The distance between anodes and cathodes and the distance between beamlets can be optimized to reduce azimuthal drifts caused by the space charge electric field. The magnetic system 127 may be configured so that the guide magnetic field has no global radial component, thus eliminating azimuthal magnetic drifts. A beam voltage in the approximate range between 20 to 40 kV and individual cathode currents of approximately 2.56 A may be applied in order to correspond to a beamlet perveance below about $0.8\times10^{-6}$ A-V$^{-3/2}$. Each gun forms a beamlet approximately 6 mm in diameter that propagates in an approximately 10-14 mm beam tunnel. The beamlet optics in each gun may be configured independent of one another.

Figure 3A:
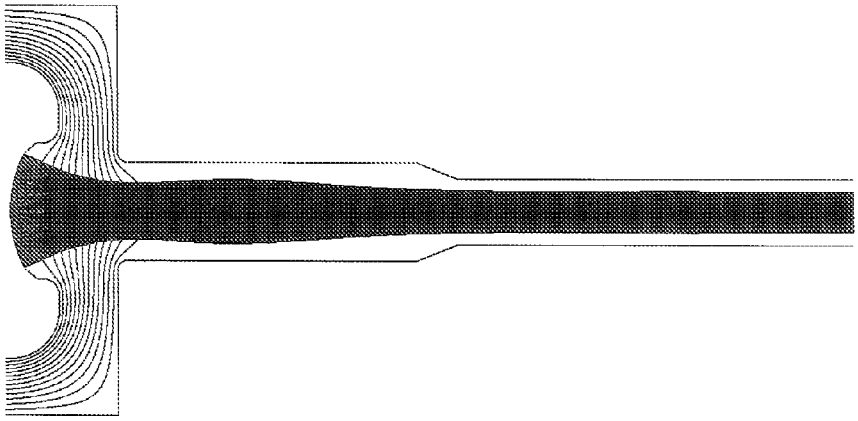
FIGS. 3*a* and 3*b* illustrate example aspects of beamlet trajectories and the longitudinal magnetic field profile of an RF source.
Figure 3B:
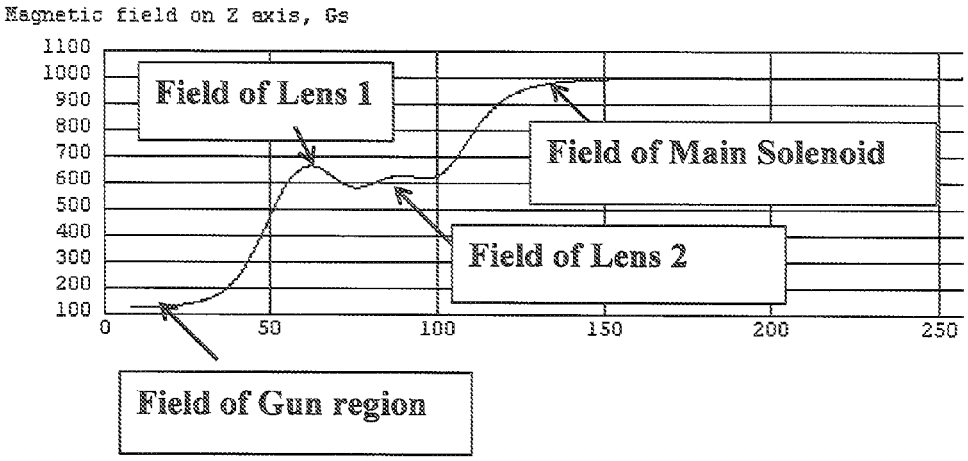
Figure 4:
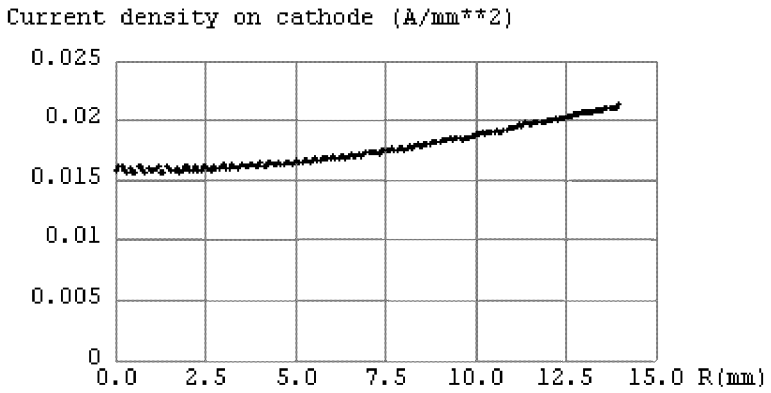
FIG. 4 illustrates example aspects of cathode loading in the RF source in FIG. 1.

The external magnetic field provides beam focusing in the electron gun 104 and in the RF system. It may include three pole pieces 160 provided in the gun region that form a focusing magnetic field suitable to guide the beam with minimal scalloping. The beamlet trajectories and the longitudinal magnetic field profile are shown in FIGS. 3*a* and 3*b*, while the cathode loading is shown in FIG. 4.

Figure 5:
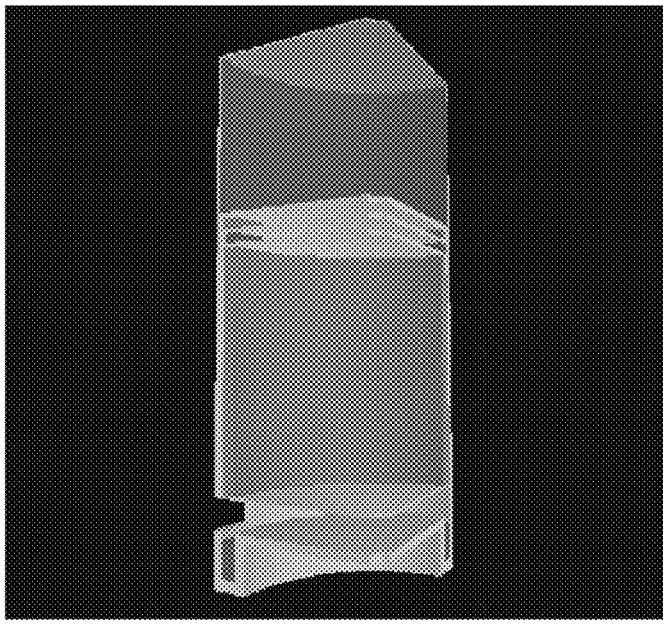
FIG. 5 illustrates example aspects of a magnetic system layout and field pattern in a cut-away portion of the gun region of the RF source in FIG. 1.
Figure 6:
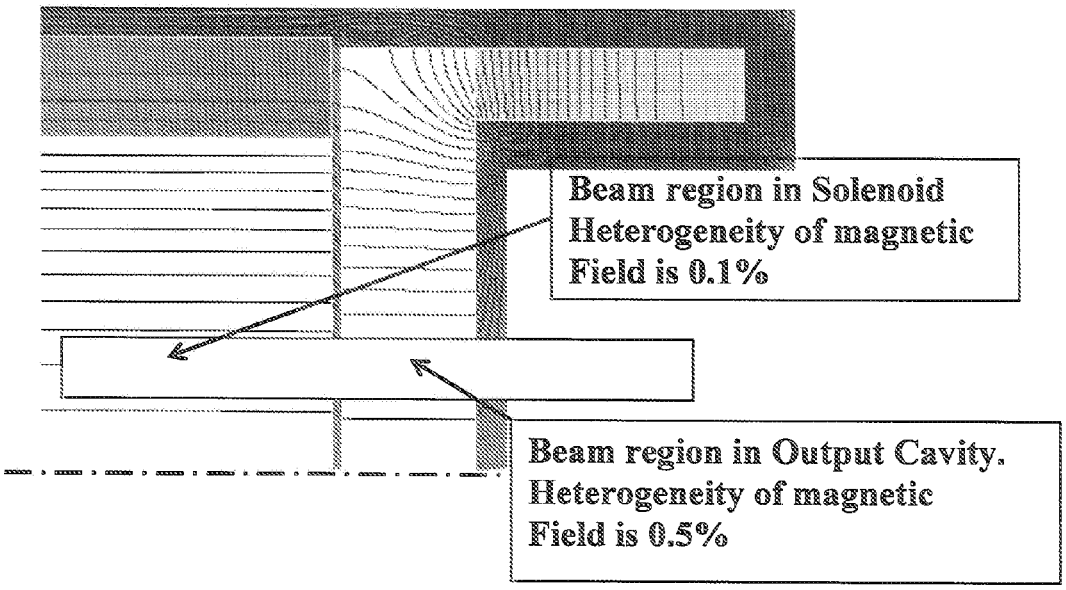
FIG. 6 illustrates example aspects of a field map of the output section of the RF source in FIG. 1.
Figure 7:
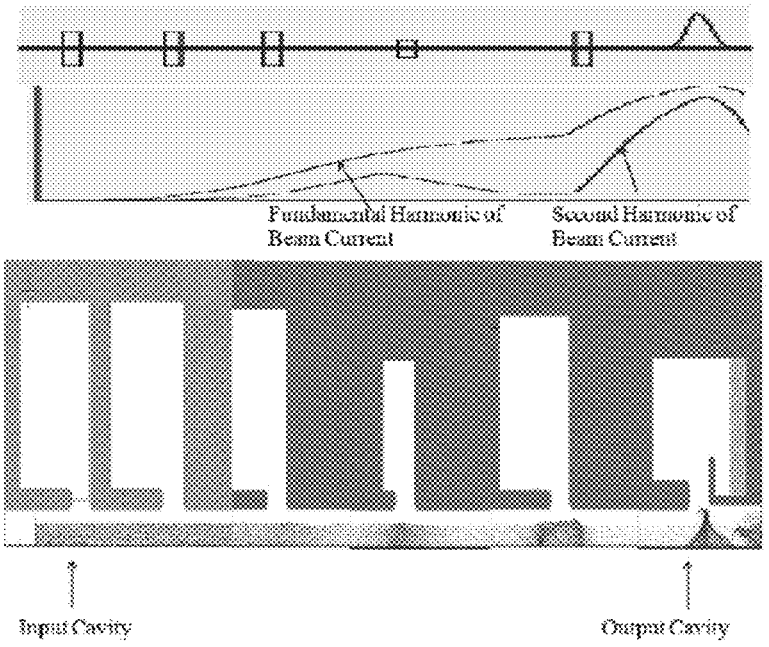
FIG. 7 illustrates example aspects of a 2D beam dynamics simulation for the RF source in FIG. 1.

The magnetic system layout and field pattern in a cut-away portion of the gun region are shown in FIG. 5, and a field map in the output section is shown in FIG. 6. An example 2D beam dynamics simulation is shown in FIG. 7.

Figure 8:
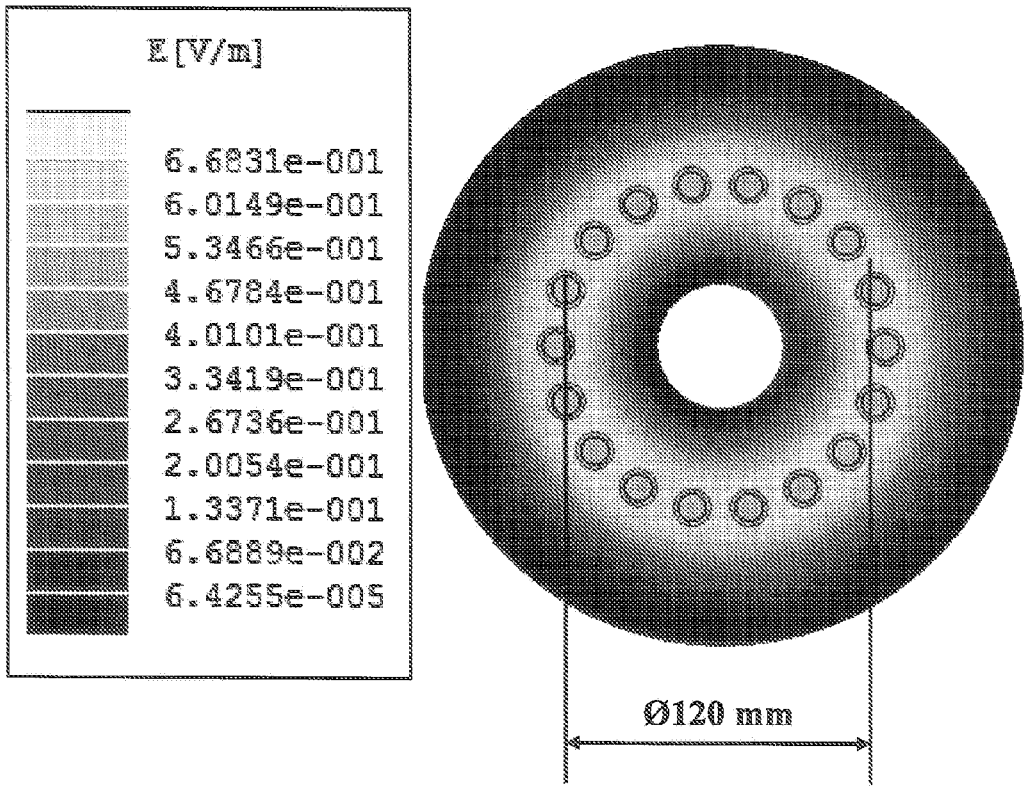
FIG. 8 illustrates example aspects of a cavity for an RF source.
Figure 9:
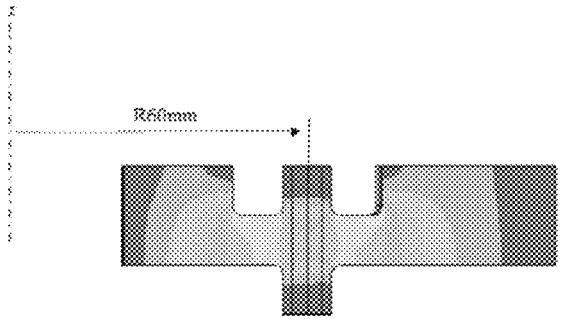
FIG. 9 illustrates example aspects of electric field distributions in an RF source.
Figure 10:
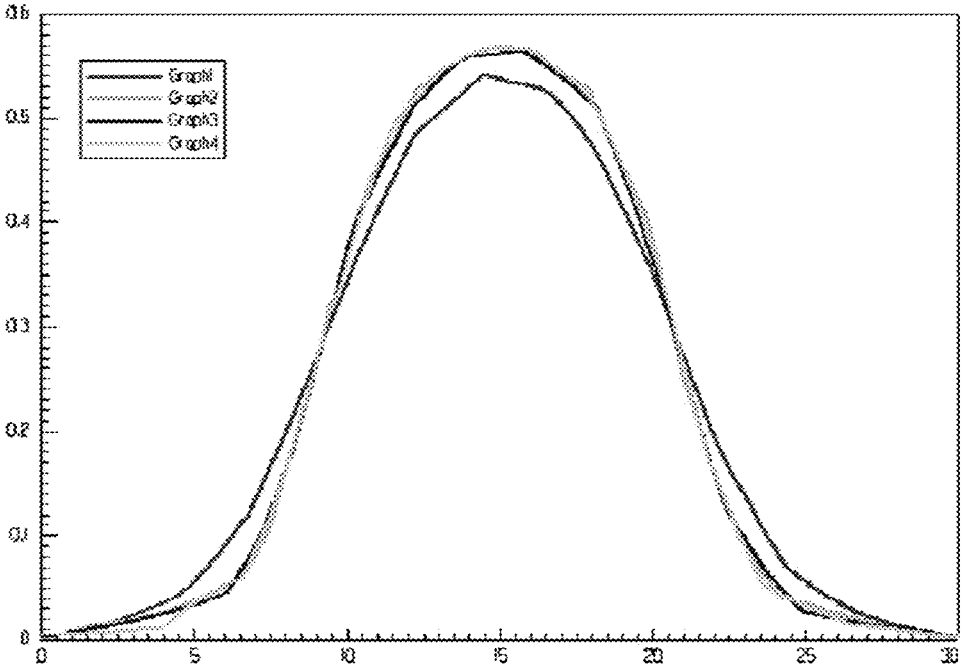
FIG. 10 illustrates example aspects of a field profile along a beamlet axis in an RF source.

Coaxial RF cavities are used for the klystron, as shown in FIGS. 8 and 9, where the cavity layout and electric field distribution are also shown. The field profile along a beamlet axis is shown in FIG. 10. These figures illustrate that the field is axisymmetrical.

Figure 11A:
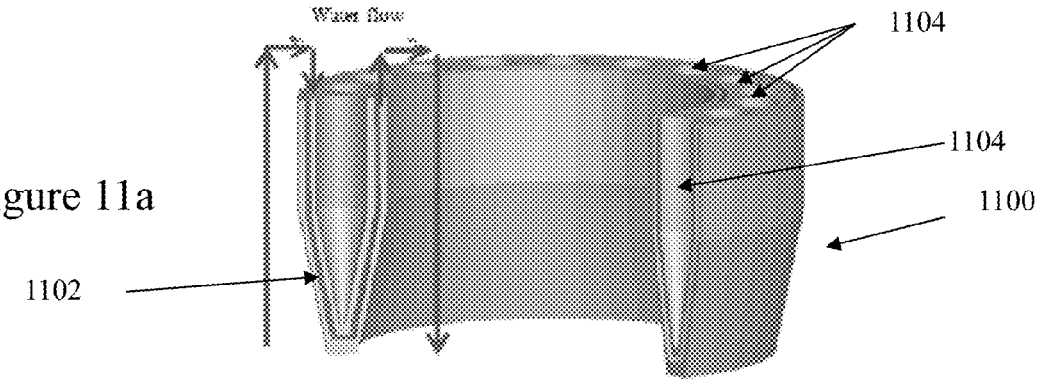
FIGS. 11*a* and 11*b* illustrate aspects of an example collector layout in an RF source.
Figure 11B:
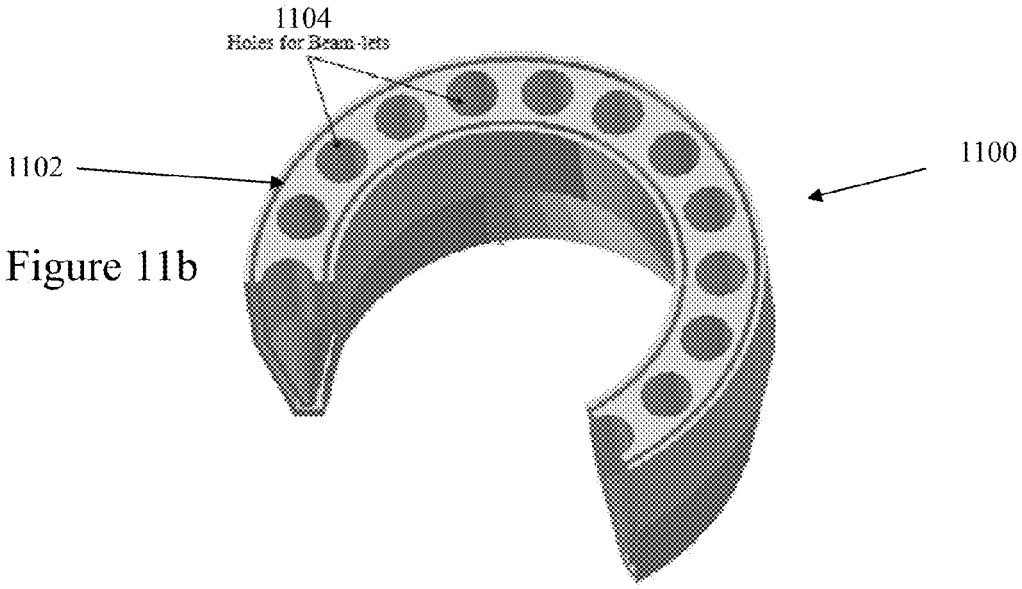
Figure 12A:
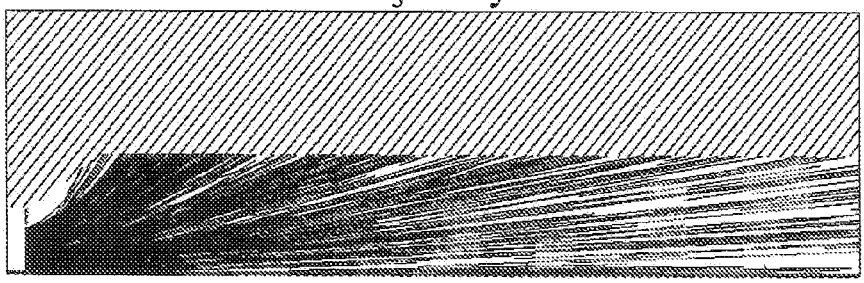
FIGS. 12*a-d* illustrate example beam trajectories and magnetic system aspects within a collector channel in an RF source.
Figure 12B:
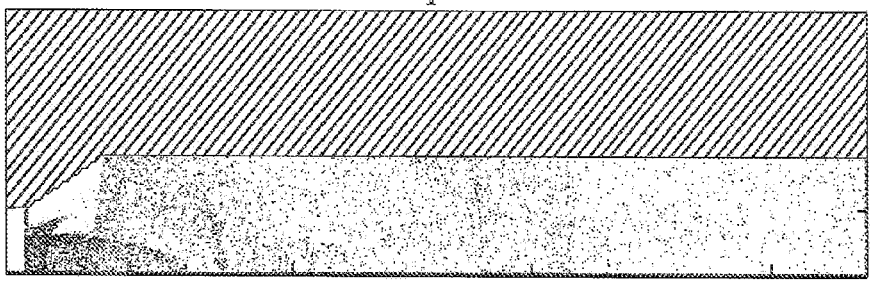
Figure 12C:
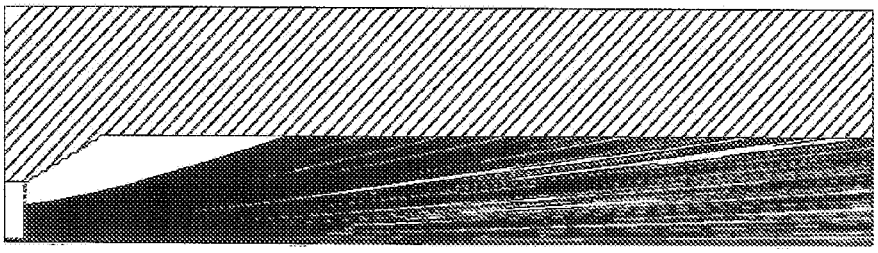
Figure 12D:
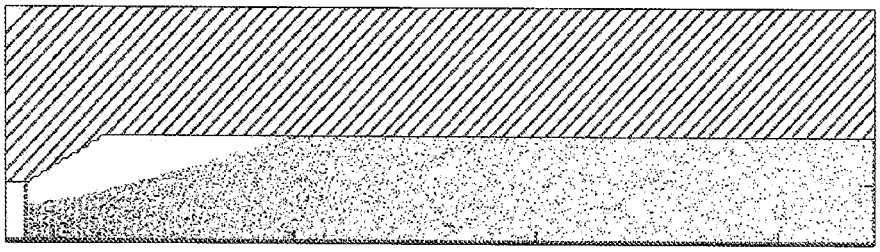

The MBK includes one common collector having the separate channels (openings), e.g., 124*a*, 124*b*, etc., for each beamlet. Two partial cut-away views of an example collector layout are illustrated in FIGS. 11*a* and 11*b*. The collector 1100 includes a plurality of collector channels or openings 1104 corresponding to each of the beamlets in the cathode. The collector may be configured to include between 10-20 collector channels corresponding an electron gun having eighteen beamlet cathodes. The collector channels have no RF coupling to each other. Aspects may further include a beam collector capable of operating with a beam having a peak power of up to 1 MW and an average power of up to 60 kW.

FIGS. 11*a* and 11*b* also illustrate a cooling feature that may be included in the collector. For example, collector 1100 may include a passage 1102 that runs adjacent to the collector channel 1104. The passage may be configured to receive a flow of water that enters and exits the passage in the collector 1100 in order to cool the collector.

FIGS. 12*a-d* illustrate example beam trajectories and magnetic system aspects within one of the collector channels, e.g., 1104 from FIG. 11.

Figure 13:
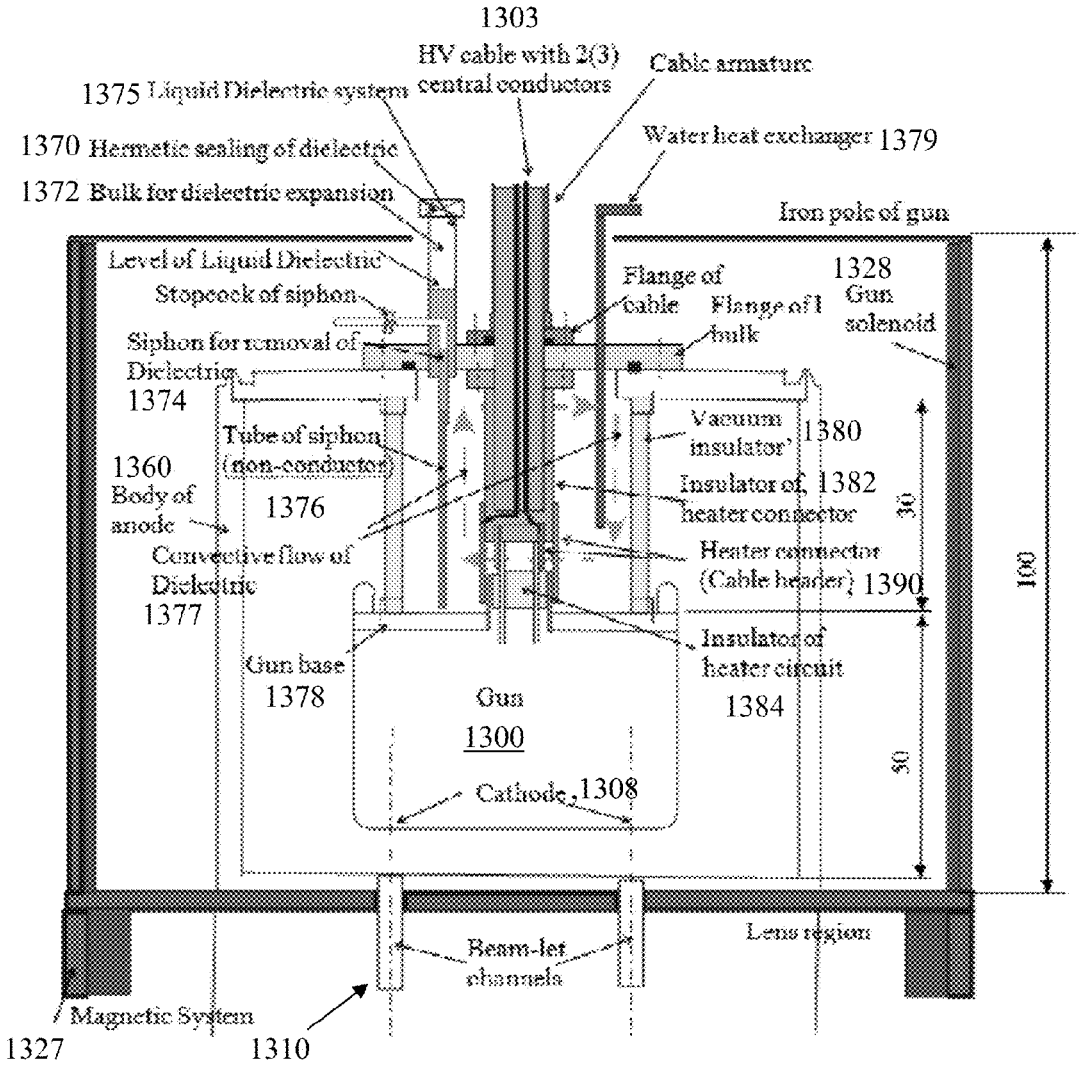
FIG. 13 illustrates example aspects of a low-voltage, multi-beam RF source.

FIG. 13 illustrates an example electron gun having different aspects than those illustrated in FIG. 1. The electron gun 1300 is provided within solenoid 1328, as part of magnetic system 1327. Gun 1300 includes a plurality of beamlet cathodes 1308, e.g., eighteen, configured to generate a plurality of beamlets. Beamlet drift tubes 1310, may be used to connect between the beamlet cathodes and an input cavity. Thereafter, the beamlets pass through a series of gain cavities and an output cavity before entering a collector, as described in connection with FIG. 1.

FIG. 13 illustrates an anode body 1360 surrounding the cathode 1308. A cable header 1390 provides a connection to the electron gun insulator. A high voltage cable 1303 having central conductors is received in an opening in the gun 1300.

FIG. 13 also illustrates insulation aspects that may be incorporated in an electron gun. For example, the electron gun 1300 in FIG. 13 includes an inverted insulator. Electron gun 1300 may include a liquid insulator, such as an insulating oil, as part of a liquid dielectric system 1375. The insulating liquid may flow in a passageway 1377 surrounding the portion of the gun 1300 that receives a high voltage cable. The flow of liquid is shown with arrows in FIG. 13. The gun base 1378 separates the passageway 1377 from the cathode 1308. A water heater exchanger 1379 may extend into the passageway 1377 so that it extends into the flow of liquid.

A seal 1370 may be provided that hermetically seals the liquid insulator. A bulk reservoir 1372 may be provided to compensate for potential expansion of the liquid insulator. A siphon 1374 may be provided for adding and removing the liquid insulator. The siphon may include a tube 1376 that extends into a passageway through which the insulating liquid flows. The siphon tube may be non-conductive.

The insulating oil that surrounds the gun insulator may be, e.g., non-flammable liquid MIDEL 7131. Additional details regarding MIDEL 7131 can be found at http://www.midel-.com/fire-safety.htm, the entire contents of which are hereby incorporated by reference herein. A small volume of the liquid insulator may be used, e.g., approximately 0.6 liters.

Additional insulators may be provided in the gun 1300. For example, a vacuum insulator 1380 may be provided as a wall of the passageway 1377 that extends between the gun base and an upper portion of the gun 1300. A cable insulator 1382 may be provided surrounding the portion of the high voltage cable that is received in the gun 1300. An additional insulator 1384 may be provided for the heater circuit.

The electron gun illustrated in FIG. 13 provides a small length and diameter of a ceramic insulator, a small length for a circuit for connection to an external cable, a small volume of the liquid insulator, and effective cooling of the cathode by convection in the oil.

The electron gun of either FIG. 1 or FIG. 13 may be configured as a diode gun having between 10-20 cathodes, which produces 20-40 kV, 2.56 A electron beamlets. The electron gun may be configured so that the current density on the cathode does not exceed 2.5 A/cm$^2$. The electron gun may be configured so that it can be operated with the RF system of the MBK having an axial guide magnetic field of about 1 kG in order to provide good beam focusing and a lack of current interception that is essential for operating at high average power.

Various aspects or features will be presented in terms of systems that may include a number of devices, components, modules, and the like. It is to be understood and appreciated that the various systems may include additional devices, components, modules, etc. and/or may not include all of the devices, components, modules etc. discussed in connection with the figures. A combination of these approaches may also be used.

While the foregoing disclosure discusses illustrative aspects and/or embodiments, it should be noted that various changes and modifications could be made herein without departing from the scope of the described aspects and/or embodiments as defined by the appended claims. Furthermore, although elements of the described aspects and/or embodiments may be described or claimed in the singular, the plural is contemplated unless limitation to the singular is explicitly stated. Additionally, all or a portion of any aspect and/or embodiment may be utilized with all or a portion of any other aspect and/or embodiment, unless stated otherwise.

While this invention has been described in conjunction with the example implementations outlined above, various alternatives, modifications, variations, improvements, and/or substantial equivalents, whether known or that are or may be presently unforeseen, may become apparent to those having at least ordinary skill in the art. Accordingly, the example implementations of the invention, as set forth above, are intended to be illustrative, not limiting. Various changes may be made without departing from the spirit and scope of the invention. Therefore, the invention is intended to embrace all known or later-developed alternatives, modifications, variations, improvements, and/or substantial equivalents.

What is claimed is:

1. A low-voltage, multi-beam radio frequency (RF) source, comprising:

an electron gun including a plurality of cathodes emitting a plurality of individual beams; and an output cavity common to the plurality of beams;

a single, multi-channel beam collector provided proximate to the output section, wherein the beam collector includes a plurality of beam collector channels, each channel corresponding to an individual beam from the cathode.

2. The RF source according to claim 1, wherein the power source operates at a voltage in of between 20 to 40 kV.

3. The RF source according to claim 1, herein the cathode comprises a plurality of cathodes, each being configured to generate a single beam.

4. The RF source according to claim 3, wherein the plurality of cathodes are located in regular intervals on a ring around a central axis of the RF source.

5. The RF source according to claim 3, wherein the RF source operates at a pulse width of approximately between 5 to 40 ms.

6. The RF source according to claim 3, wherein each cathode is configured to form a beam having a diameter of approximately 6 mm, and wherein the RF source comprises a plurality of beam tunnels between approximately 10 to 14 mm in which the beams propagate.

7. The RF source according to claim 3, wherein each cathode comprises beam optics independent of the other-cathodes.

8. The RF source according to claim 1, wherein the electron gun comprises a ferrite damper.

9. The RF source according to claim 1, further comprising:

a common input cavity; and a plurality of gain cavities provided between the input cavity and the output cavity, wherein the input cavity, the output cavity, and the plurality of gain cavities comprise a plurality of common coaxial cavities through which the plurality of beams pass.

10. The RF source according to claim 1, further comprising:

an air radiator configured to pass a flow of air through the RF source adjacent to the electron gun.

11. The RF source according to claim 1, further comprising:

a liquid dielectric system including a passageway configured to receive a flow of liquid adjacent the electron gun.

12. The RF source according to claim 11, wherein the liquid comprises oil.

13. The RF source according to claim 1, wherein each of the plurality of channels is independent of RF coupling to the other channels.

14. The RF source according to claim 1, wherein the beam collector further comprises a cooling feature.

15. The RF source according to claim 14, wherein the cooling feature comprises a passage formed in the collector at least partially surrounding the plurality of channels, and wherein the passageway is formed to receive a flow of liquid.

16. The RF source according to claim 1, further comprising a magnetic circuit configured to compensate for asymmetry in path in which the beams travel.

17. The RF source according to claim 16, wherein the magnetic circuit includes a pair of lenses.

18. The RF source according to claim 16, wherein the magnetic circuit includes a gun solenoid having a uniform magnetic field in a region of the electron gun.

19. The RF source according to claim 1, wherein the magnetic circuit includes a plurality of compensating coils provided surrounding an output section of the RF source.

20. The RF source according to claim 1, further comprising:

a plurality of electron guns, each electron gun comprising a plurality of cathodes, each cathode emitting an individual beam; and a plurality of multi-channel beam collectors, each beam collector corresponding to a single electron gun, wherein each multi-beam collector comprises a plurality of beam absorbing channels, each opening corresponding to an individual beam.

* * * * *